US009113685B2

(12) United States Patent
Iwai

(10) Patent No.: US 9,113,685 B2
(45) Date of Patent: Aug. 25, 2015

(54) SHOULDER STRAP SLIPPAGE PREVENTION DEVICE AND SHOULDER BAG USING SAME

(76) Inventor: Kazuo Iwai, Niigata (JP)

( * ) Notice: Subject to any disclaimer, the term of this patent is extended or adjusted under 35 U.S.C. 154(b) by 0 days.

(21) Appl. No.: 14/343,950

(22) PCT Filed: Apr. 27, 2012

(86) PCT No.: PCT/JP2012/061398

§ 371 (c)(1),
(2), (4) Date: Mar. 10, 2014

(87) PCT Pub. No.: WO2013/038747

PCT Pub. Date: Mar. 21, 2013

(65) Prior Publication Data

US 2014/0224389 A1 Aug. 14, 2014

(30) Foreign Application Priority Data

Sep. 12, 2011 (JP) ..... 2011-198626

(51) Int. Cl.

| | |
|---|---|
| ***A45F 3/14*** | (2006.01) |
| ***A45C 1/02*** | (2006.01) |
| ***A45C 3/06*** | (2006.01) |
| ***A45C 13/30*** | (2006.01) |
| ***A45C 15/00*** | (2006.01) |

(52) U.S. Cl.

CPC ... *A45C 1/02* (2013.01); *A45C 3/06* (2013.01); *A45C 13/30* (2013.01); *A45C 15/00* (2013.01); *A45F 3/14* (2013.01); *A45C 2013/306* (2013.01)

(58) Field of Classification Search

CPC ..... B61D 43/00; Y02T 30/36; B66C 9/12; B66C 9/14; B61B 13/04

USPC ..... 150/100, 107, 109; 224/258, 609, 149, 224/257, 646, 627, 160, 579, 618, 602; D3/215, 218, 224

See application file for complete search history.

(56) References Cited

U.S. PATENT DOCUMENTS

| | | | | | |
|---|---|---|---|---|---|
| 1,797,359 | A | * | 3/1931 | Meyers | 224/587 |
| D386,613 | S | * | 11/1997 | Terzian | D3/289 |
| 5,816,460 | A | * | 10/1998 | Cook | 224/260 |

(Continued)

FOREIGN PATENT DOCUMENTS

| | | |
|---|---|---|
| JP | 61174423 | 10/1986 |
| JP | 62177314 | 11/1987 |

(Continued)

*Primary Examiner* — Fenn Mathew
*Assistant Examiner* — Cynthia Collado
(74) *Attorney, Agent, or Firm* — Novak Druce Connolly Bove + Quigg LLP

(57) ABSTRACT

A shoulder strap slippage prevention device not only wearable with simple actions, but alleviating an uncomfortable feeling of having one's body pressed; and a shoulder bag using it. The device includes a band-shaped prevention device body; a strap attachment part allowing one end of the device body to be attached to a shoulder strap of a shoulder bag; and a balance weight provided on the other end thereof. The strap attachment part is attached to the shoulder strap hung on a user's shoulder, and the device body is then placed around his/her neck such that the balance weight can hang off his/her other shoulder, causing a tensile force to be applied to the device body in a range from one shoulder to the other. The device can be worn with simple actions, preventing the shoulder strap from slipping off while alleviating an uncomfortable feeling of having the user's body pressed.

8 Claims, 10 Drawing Sheets

(56) References Cited

U.S. PATENT DOCUMENTS

| | | | | |
|---|---|---|---|---|
| D414,332 | S * | 9/1999 | Brechard | D3/231 |
| 6,446,849 | B1 * | 9/2002 | Schleifer | 224/258 |
| 6,866,173 | B2 * | 3/2005 | Haber | 224/160 |
| D547,942 | S * | 8/2007 | Lavine | D3/218 |
| 7,316,340 | B2 * | 1/2008 | Marik | 224/637 |
| D574,608 | S * | 8/2008 | Menzel et al. | D3/215 |
| D594,223 | S * | 6/2009 | Jackson | D3/215 |
| D707,961 | S * | 7/2014 | Surlaya et al. | D3/224 |
| 8,967,439 | B2 * | 3/2015 | Vitangcol et al. | 224/646 |
| 2012/0080126 | A1 * | 4/2012 | Marcin | 150/109 |

FOREIGN PATENT DOCUMENTS

| | | |
|---|---|---|
| JP | 2003174916 | 6/2003 |
| JP | 2011062516 | 3/2011 |

* cited by examiner

SHOULDER STRAP SLIPPAGE PREVENTION DEVICE AND SHOULDER BAG USING SAME

CROSS-REFERENCE TO RELATED APPLICATIONS

This application is a §371 national stage entry of International Application No. PCT/JP2012/061398, filed Apr. 27, 2012, which claims priority to JP Application No. 2011-198626, filed Sep. 12, 2011, which are hereby incorporated herein by reference in their entireties.

TECHNICAL FIELD

The present invention relates to a shoulder strap slippage prevention device for use in a shoulder bag; and a shoulder bag using the same.

BACKGROUND ART

Conventionally, shoulder straps installed in shoulder bags have exhibited a problem of slipping off easily. In order to prevent such shoulder strap from slipping off, there has been disclosed a slippage prevention device in which one end thereof is to be fixed to the shoulder strap, and the other end thereof is to be directly latched onto a certain part of a user's body such as the neck, a lower armpit region and the like (e.g. Patent document 1).

PRIOR ART DOCUMENTS

Patent Documents

Patent document 1: Japanese Unexamined Patent Application Publication No. 2011-62516

DISCLOSURE OF THE INVENTION

Problem to be Solved by the Invention

A problem with the conventional slippage prevention device is that since the device is to be directly latched onto the user's body, there exists an uncomfortable feeling of having one's body pressed.

Here, in view of the aforementioned problem, it is an object of the invention of the present application to provide: a shoulder strap slippage prevention device not only having a degree of freedom of being wearable with simple actions, but also alleviating an uncomfortable feeling of having one's body pressed; and a shoulder bag using the same.

Means to Solve the Problem

A shoulder strap slippage prevention device of a first aspect of the present invention includes: a band-shaped prevention device body; a strap attachment part allowing one end of the prevention device body to be attached to a shoulder strap of a shoulder bag; and a balance weight part provided on an other end of the prevention device body, in which the strap attachment part is attached to the shoulder strap slung over one shoulder of a user, the prevention device body is then placed around the user's neck such that the balance weight part can hang off an other shoulder of the user, thereby allowing a weight of the balance weight part to develop a tensile force to be applied to the prevention device body in a range from the one shoulder to the other shoulder.

According to a shoulder strap slippage prevention device of a second aspect of the present invention, the balance weight part is configured as a coin case.

A shoulder bag of a third aspect of the present invention includes the shoulder strap slippage prevention device as set forth in the first aspect and the second aspect.

Effects of the Invention

The invention as set forth in the first aspect of the present invention, has a degree of freedom to be worn with simple actions, and is capable of preventing the shoulder strap from slipping off while alleviating an uncomfortable feeling of having the user's body pressed.

According to the invention as set forth in the second aspect, since the balance weight part is configured as a coin case, not only the slippage prevention device can be used as a container, but the weight of the balance weight part can be easily adjusted by increasing or decreasing the number of the coins therein.

According to the invention as set forth in the third aspect, provided is a shoulder bag that has a degree of freedom to be worn with simple actions, and is capable of preventing the shoulder strap from slipping off while alleviating an uncomfortable feeling of having the user's body pressed.

BEST MODE FOR CARRYING OUT THE INVENTION

Figure 1:
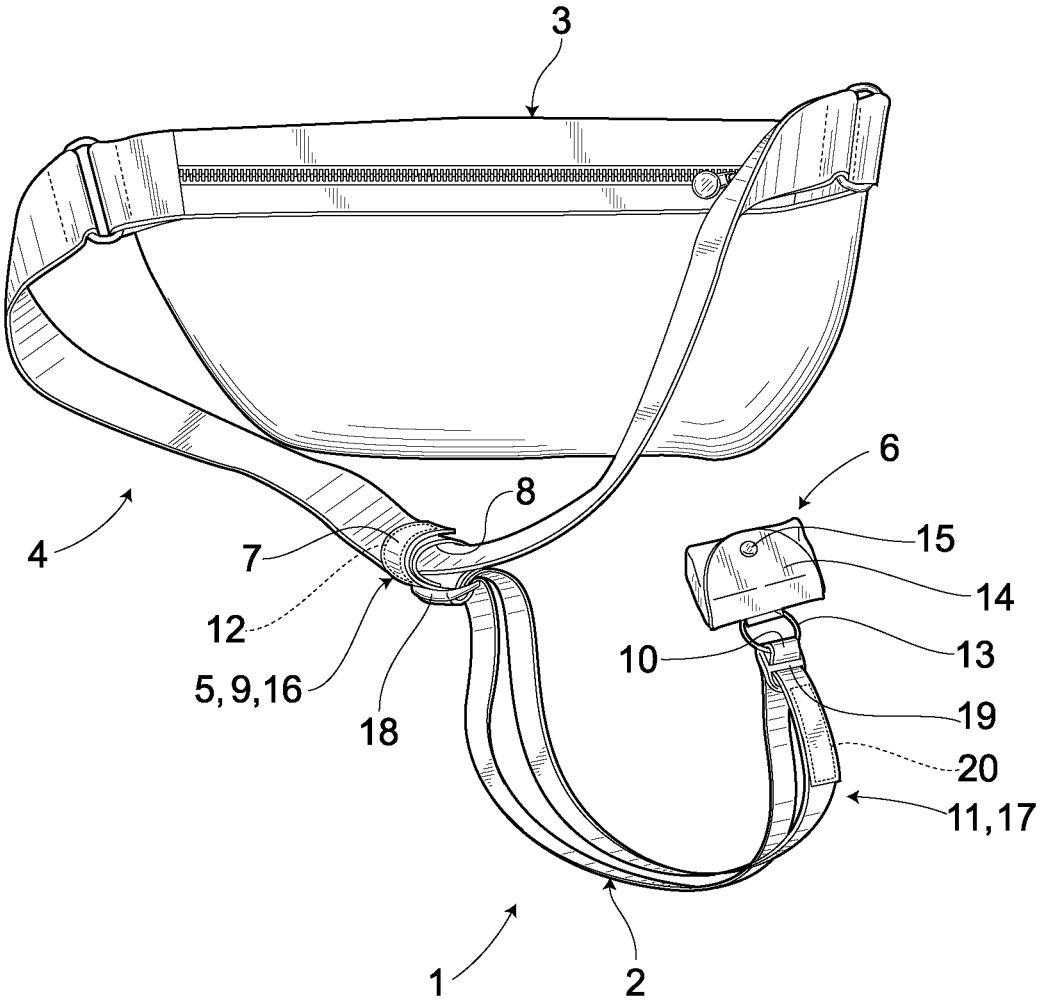
FIG. 1 is a plan view showing a state where a shoulder strap slippage prevention device of a first embodiment of the present invention is attached to a shoulder bag.
Figure 2:
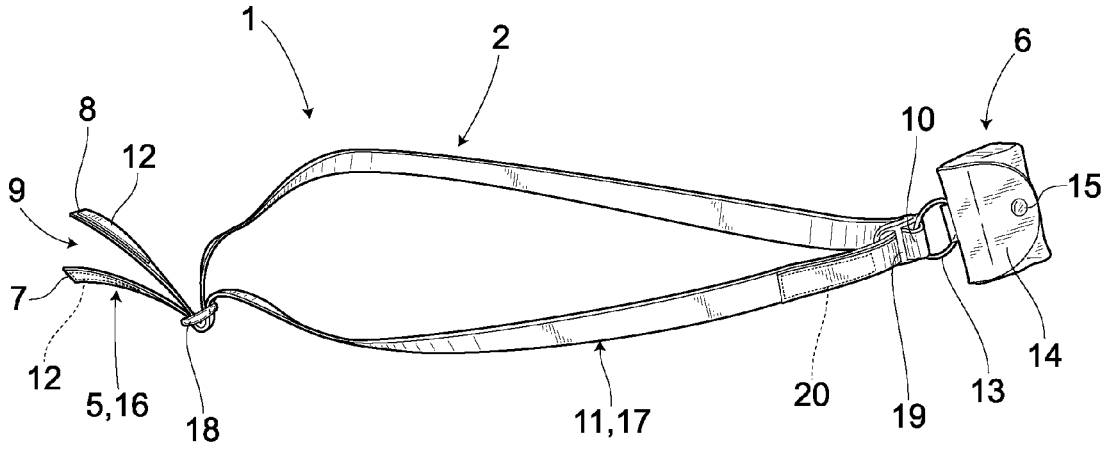
FIG. 2 is a plan view of the shoulder strap slippage prevention device of the first embodiment whose strap attachment part is opened.
Figure 3:
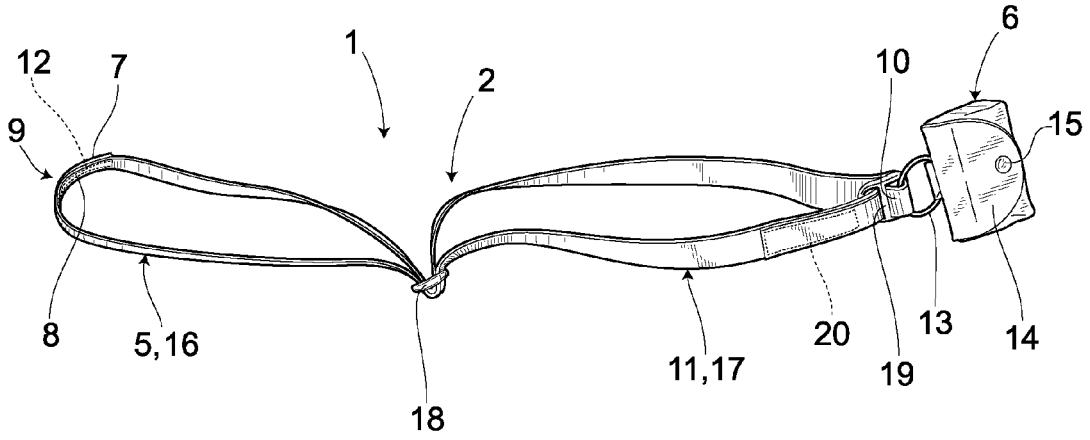
FIG. 3 is a plan view of the shoulder strap slippage prevention device of the first embodiment whose strap attachment part is closed.
Figure 4:
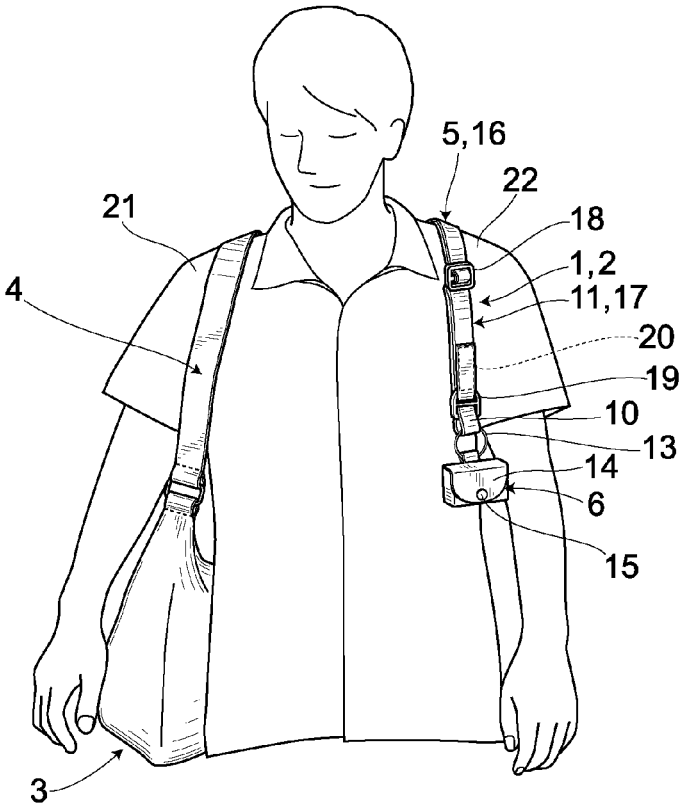
FIG. 4 is a front view showing a usage state of the shoulder strap slippage prevention device of the first embodiment.
Figure 5:
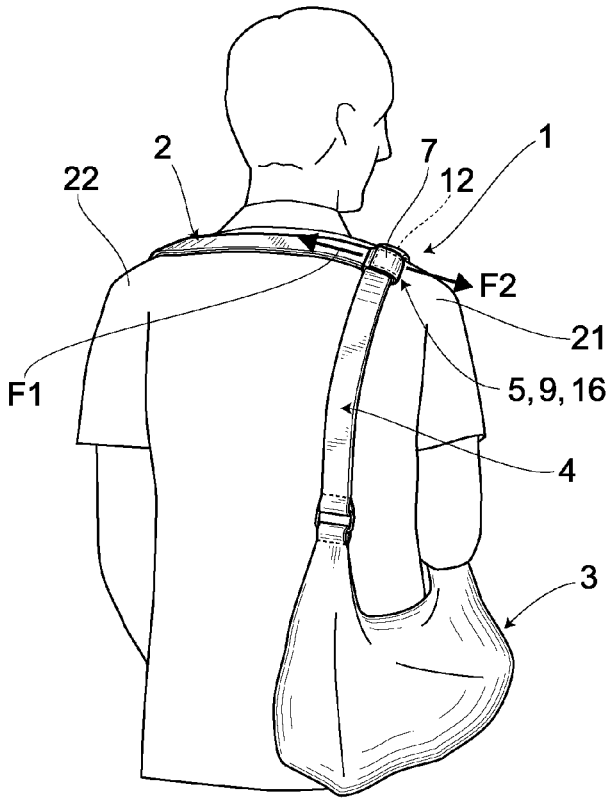
FIG. 5 is a rear view showing the usage state of the shoulder strap slippage prevention device of the first embodiment.

Preferred embodiments of the present invention are described with reference to the accompanying drawings. However, the embodiments described hereunder shall not limit the contents of the present invention that are found in the scope of claims. Further, not all elements described hereunder are necessarily the essential elements of the present invention.

First Embodiment

FIG. 1 to FIG. 9 show a first embodiment of the present invention. A shoulder strap slippage prevention device 1 includes: a band-shaped prevention device body 2; a strap attachment part 5 allowing one end of the prevention device body 2 to be attached to a shoulder strap 4 of a shoulder bag 3; and a balance weight part 6 provided on the other end of the prevention device body 2.

The prevention device body 2 is formed by folding a band-shaped member in two with one end 7 and the other end 8 thereof being pointed to each other. Here, while one end of the prevention device body 2 is configured as an openable portion 9 having the one end 7 and the other end 8, the other end thereof is configured as a closed portion 11 formed of a folded-back portion 10. Further, the prevention device body 2 may also be an elastic band-shaped member that is partially or entirely made of an elastic material such as a rubber cord or the like.

As for the strap attachment part 5, the one end 7 and other end 8 of the openable portion 9 can be attached to and detached from each other by means of a first surface fastener 12 serving as a first attachment/detachment section.

The balance weight part 6 is formed of a coin case that is coupled to an annular hardware 13 provided on the folded-back portion 10 of the closed portion 11; and is capable of containing coins, medals or the like. Here, a lid body 14 of this coin case can be opened and closed by means of a snap button 15.

Further, as for a range between the openable portion 9 and the closed portion 11 of the prevention device body 2, there are provided an openable-portion-side annular section 16 and a closed-portion-side annular section 17 in a divided manner. Furthermore, there is installed a length adjustment buckle 18 for adjusting relative lengths of the openable-portion-side annular section 16 and the closed-portion-side annular section 17.

In addition, disposed on the closed portion 11 of the prevention device body 2 is a fixation buckle 19 for fixing the position of the annular hardware 13.

Particularly, as for the closed portion 11, a region other than the folded-back portion 10 but close to where the fixation buckle 19 is disposed can be opened by means of a second surface fastener 20 serving as a second attachment/detachment section.

Described hereunder is a method for using the shoulder strap slippage prevention device 1 having the aforementioned structure. First of all, the shoulder strap 4 is to be passed through the openable-portion-side annular section 16 of the openable portion 9 that has been formed into an annular shape by coupling the one end 7 and the other end 8 to each other through the first surface fastener 12. In this way, the slippage prevention device 1 can be attached to the shoulder strap 4.

Subsequently, with the slippage prevention device 1-attached shoulder strap 4 hanging on a shoulder 21 of a user, the prevention device body 2 is to be placed around the user's neck from his/her back side such that the closed portion 11 having the balance weight part 6 may hang off an other shoulder 22, the balance weight part 6 containing coins (not shown) as weights.

Here, due to the weight of the balance weight part 6 hanging off the other shoulder 22, a tensile force F1 is applied to the prevention device body 2 in a range from the shoulder 21 to the other shoulder 22. Therefore, while the shoulder strap 4 tends to slip off the shoulder 21 due to the weight of the shoulder bag 3, the slippage prevention device 1, with the aid of the strap attachment part 5, allows the shoulder strap 4 to be pulled also in the direction of the other shoulder 22, i.e. a direction opposite to the direction along which the shoulder strap 4 slips off. That is, a force F2 causing the shoulder strap 4 to slip off the shoulder 21 and the tensile force F1 from the slippage prevention device 1 shall cancel each other out, thereby allowing a frictional force between the shoulder strap 4 and the shoulder 21 to be retained, thus preventing the shoulder strap 4 from slipping off.

Particularly, the weight of the balance weight part 6 can be easily modified by increasing or decreasing the number of the coins therein.

Moreover, when, for example, hanging the shoulder bag 3 diagonally across the body and the slippage prevention device 1 is therefore not needed, the openable portion 9 can be opened by unfastening the first surface fastener 12, thus making it possible to remove the slippage prevention device 1 from the shoulder strap 4.

As for the closed portion 11, by unfastening the second surface fastener 20, the balance weight part 6 can be installed or removed together with the annular hardware 13, thus simplifying the replacement or the like of the balance weight part 6.

Figure 6:
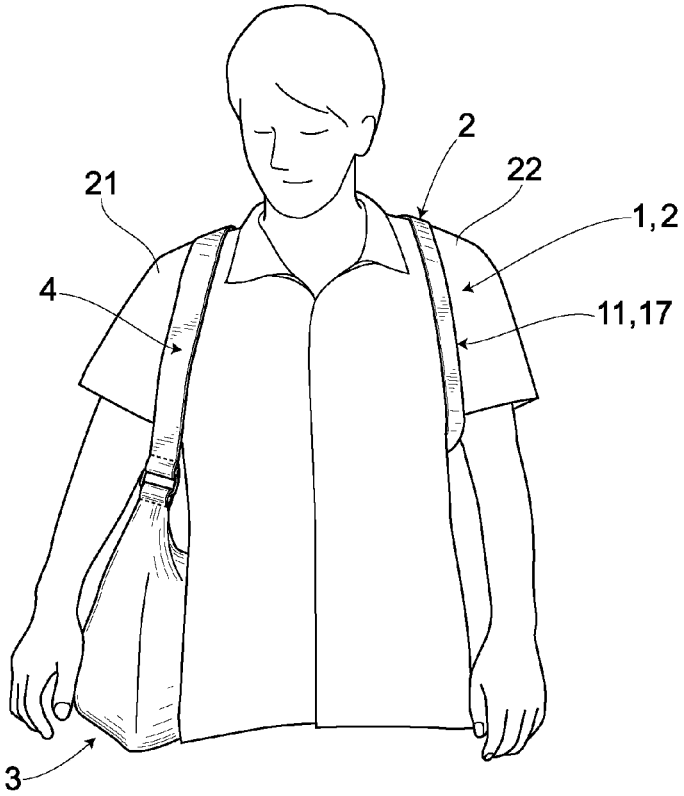
FIG. 6 is a front view showing another usage state of the shoulder strap slippage prevention device of the first embodiment.
Figure 7:
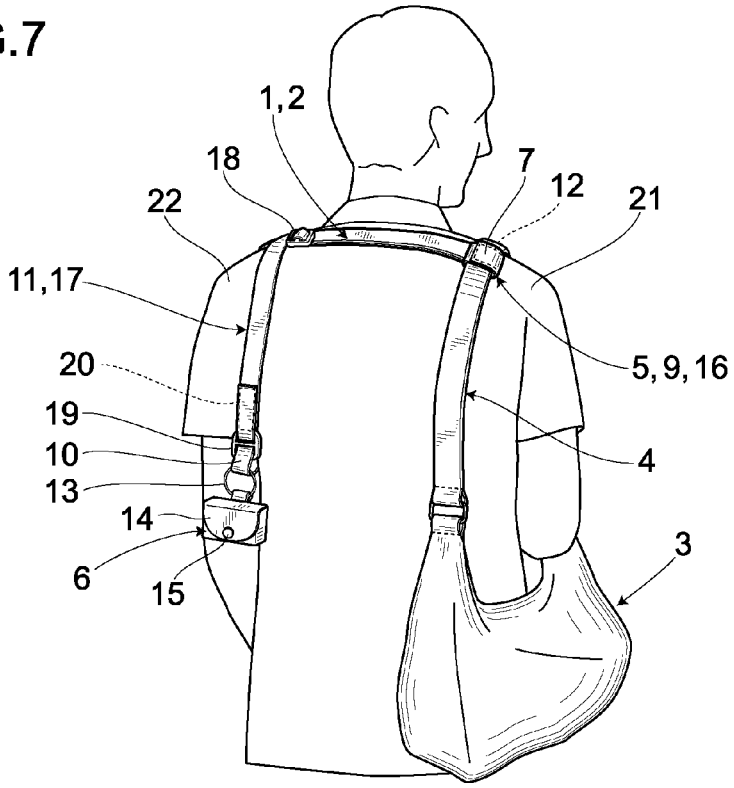
FIG. 7 is a rear view showing the above-mentioned other usage state of the shoulder strap slippage prevention device of the first embodiment.

Next, with reference to FIG. 6 and FIG. 7, another method for using the slippage prevention device 1 is described. That is, the slippage prevention device 1 whose openable-portion-side annular section 16 has already been adjusted by the length adjustment buckle 18 to a length of about a shoulder width, is to be attached to the shoulder strap 4 by passing the corresponding shoulder strap 4 of the shoulder bag 3 through the openable-portion-side annular section 16 of the openable portion 19 that has been formed into the annular shape by coupling the one end 7 and the other end 8 to each other through the first surface fastener 12.

Subsequently, with the slippage prevention device 1-attached shoulder strap 4 hanging on the shoulder 21 of the user, the prevention device body 2 is to be placed around the user's neck from his/her back side such that the closed-portion-side annular section 17 may be worn by the other shoulder 22 with the arm on the side of the other shoulder 22 being passed through this closed-portion-side annular section 17.

In this way, since the closed-portion-side annular section 17 of the slippage prevention device 1 is worn by the other shoulder 22, whenever the shoulder strap 4 tends to slip off the shoulder 21, the shoulder strap 4 shall be retained on the other shoulder 22 through the slippage prevention device 1, thus preventing the shoulder strap 4 from slipping off.

Here, since the closed-portion-side annular section 17 worn by the other shoulder 22 is pulled downward due to the weight of the balance weight part 6, relieved is a feeling of having a lower armpit region on the side of the other shoulder 22 tightened by the closed-portion-side annular section 17, thus making it possible to alleviate the uncomfortable feeling of having the body pressed. Particularly, if the prevention device body 2 is elastic, the uncomfortable feeling of having the body pressed can be alleviated even further.

Figure 8:
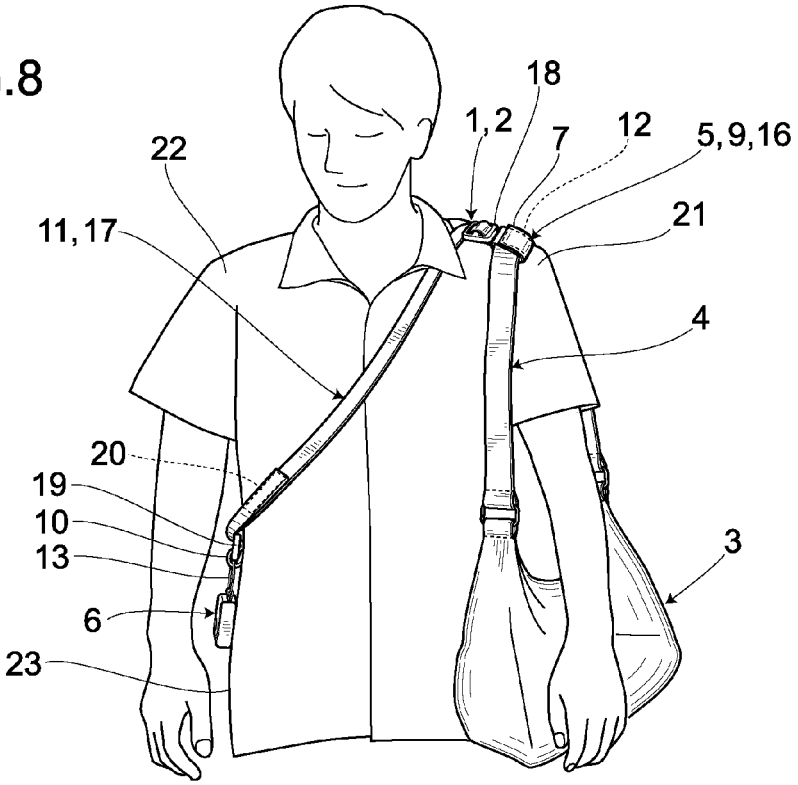
FIG. 8 is a front view showing yet another usage state of the shoulder strap slippage prevention device of the first embodiment.
Figure 9:
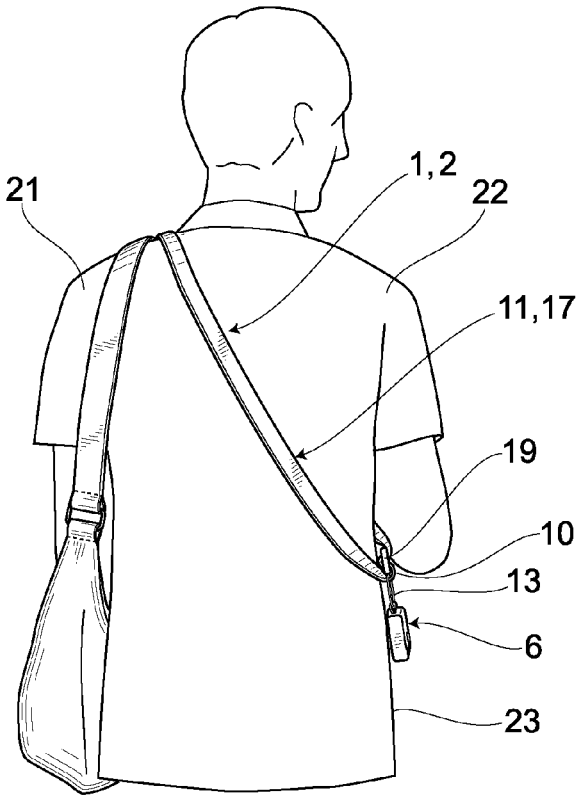
FIG. 9 is a rear view showing the above-mentioned yet another usage state of the shoulder strap slippage prevention device of the first embodiment.
Figure 10:
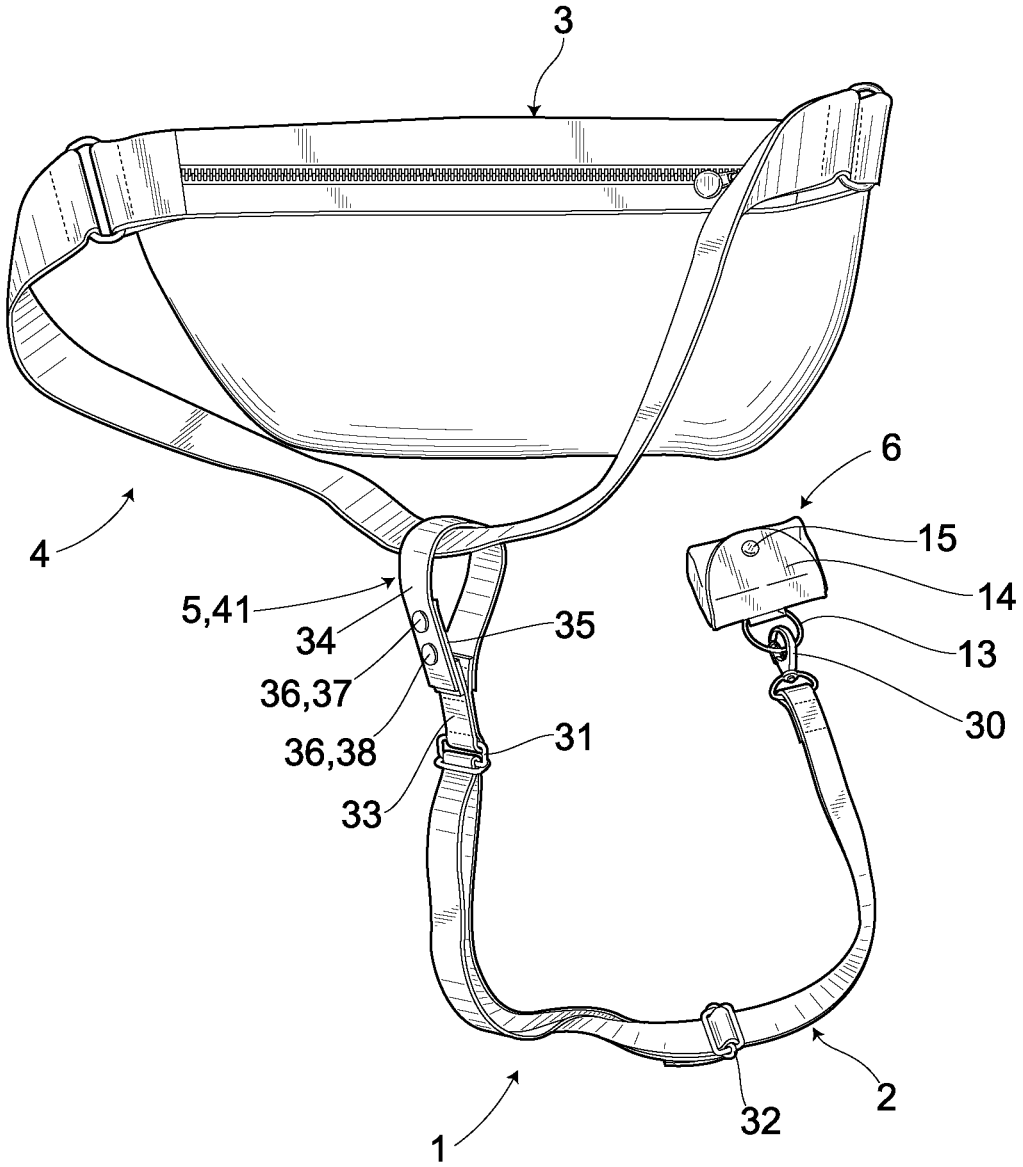
FIG. 10 is a plan view showing a state where a shoulder strap slippage prevention device of a second embodiment of the present invention is attached to a shoulder bag.
Figure 11:
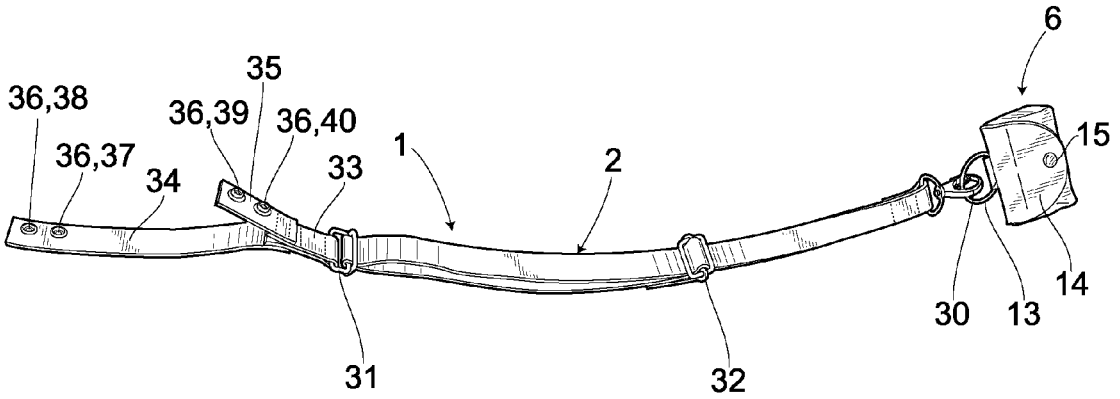
FIG. 11 is a plan view of the shoulder strap slippage prevention device of the second embodiment whose strap attachment part is opened.
Figure 12:
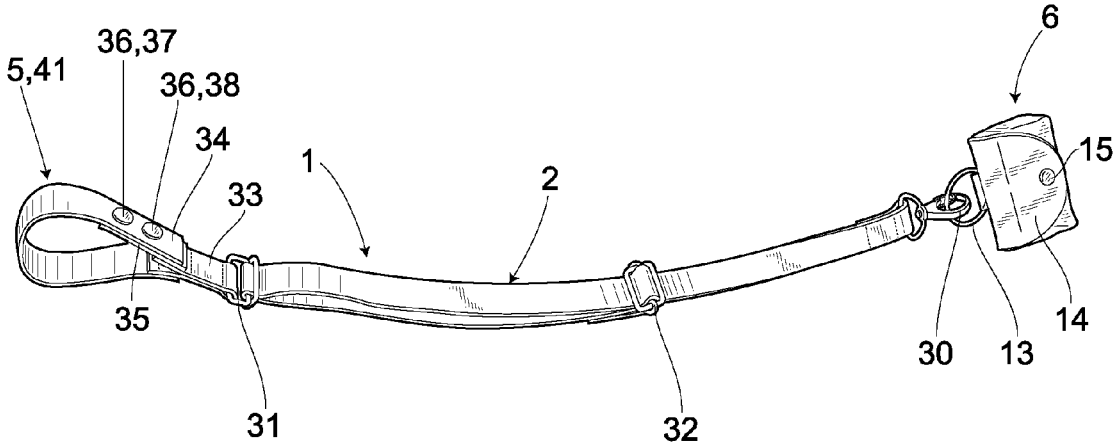
FIG. 12 is a plan view of the shoulder strap slippage prevention device of the second embodiment whose strap attachment part is closed.
Figure 13:
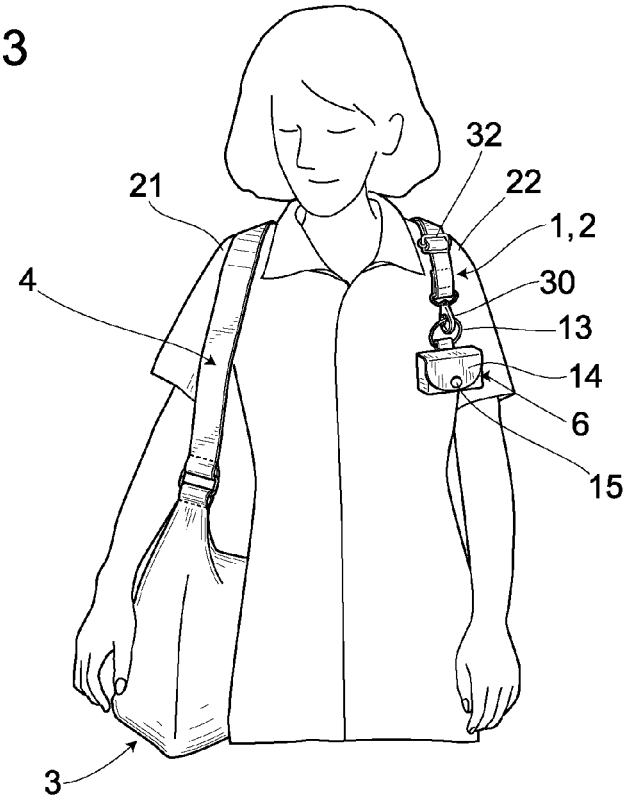
FIG. 13 is a front view showing a usage state of the shoulder strap slippage prevention device of the second embodiment.
Figure 14:
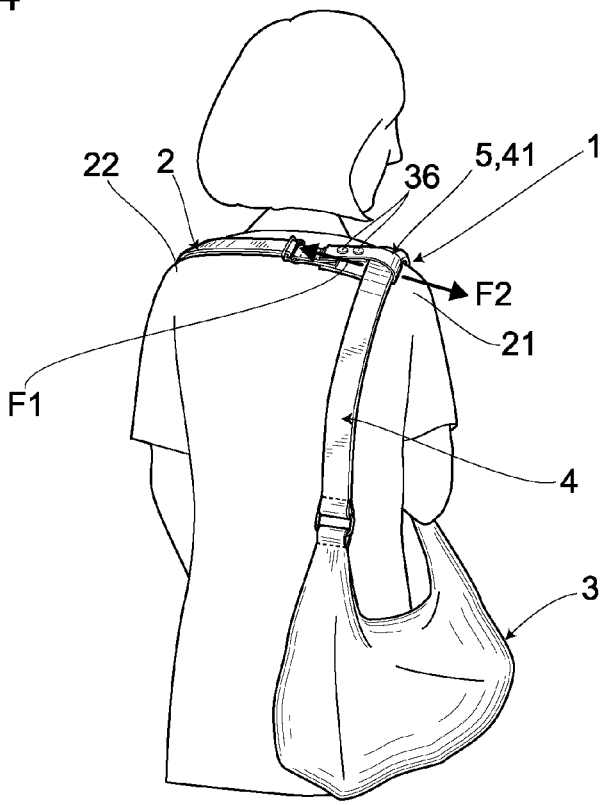
FIG. 14 is a rear view showing the usage state of the shoulder strap slippage prevention device of the second embodiment.

In addition, with reference to FIG. 8 and FIG. 9, yet another method for using the slippage prevention device 1 is described hereunder. That is, the slippage prevention device 1 whose closed-portion-side annular section 17 has already been adjusted by the length adjustment buckle 18 substantially to a length capable of being worn by the user diagonally across his/her body, is to be attached to the shoulder strap 4 by passing the corresponding shoulder strap 4 of the shoulder bag 3 through the openable-portion-side annular section 16 of the openable portion 19 that has been formed into the annular shape by coupling the one end 7 and the other end 8 to each other through the first surface fastener 12.

Subsequently, with the slippage prevention device 1-attached shoulder strap 4 hanging on the shoulder 21 of the user, the closed-portion-side annular section 17 is to be worn diagonally from the shoulder 21, thus allowing the user to wear the slippage prevention device 1.

In this way, since the slippage prevention device 1 is worn diagonally from the shoulder 21, whenever the shoulder strap 4 tends to slip off the shoulder 21, the shoulder strap 4 shall be retained by the slippage prevention device 1 to a body side region 23 on the side of the other shoulder 22, thus preventing the shoulder strap 4 from slipping off.

Here, since the closed-portion-side annular section 17 worn by the body side region 23 on the side of the other shoulder 22 is pulled downward due to the weight of the balance weight part 6, relieved is a feeling of having the body side region 23 on the side of the other shoulder 22 tightened by the closed-portion-side annular section 17, thus making it possible to alleviate the uncomfortable feeling of having the body pressed. Particularly, if the prevention device body 2 is elastic, the uncomfortable feeling of having the body pressed can be alleviated even further.

As mentioned above, there are employed: the band-shaped prevention device body 2; the strap attachment part 5 allowing one end of the prevention device body 2 to be attached to the shoulder strap 4 of the shoulder bag 3; and the balance weight part 6 provided on the other end of the prevention device body 2. Further, the strap attachment part 5 is to be attached to the shoulder strap 4 hung on the shoulder 21 of the user, followed by placing the prevention device body 2 around the user's neck such that the balance weight part 6 may then hang off the user's other shoulder 22. Here, due to the weight of the balance weight part 6, the tensile force F1 is applied to the prevention device body 2 in the range from the shoulder 21 to the other shoulder 22.

That is, the slippage prevention device 1 not only has a degree of freedom large enough to be worn with simple actions, but is also capable of alleviating the uncomfortable feeling of having the user's body pressed. In this way, the slippage prevention device 1 serves to prevent the shoulder strap 4 from slipping off.

Further, since the balance weight part 6 is configured as a coin case, not only the slippage prevention device 1 can be used as a container, but the weight of the balance weight part 6 can be easily adjusted by increasing or decreasing the number of the coins therein.

As an effect of the aforementioned embodiment, if the prevention device body 2 is elastic, the corresponding prevention device body 2 can then expand and contract around the neck, thereby making it possible to alleviate the uncomfortable feeling of, for example, having the neck area pressed.

Second Embodiment

FIG. 10 to FIG. 14 show a second embodiment of the present invention. Here, elements identical to those of the first embodiment are given identical symbols, and the detailed descriptions thereof are thus omitted. In the second embodiment, the shoulder strap slippage prevention device 1 includes: the band-shaped prevention device body 2; the strap attachment part 5 allowing one end of the prevention device body 2 to be attached to the shoulder strap 4 of the shoulder bag 3; and the balance weight part 6 provided on the other end of the prevention device body 2.

The prevention device body 2 is a band-shaped member in which one end thereof is coupled to a locking tool 30, and the other end thereof is at first passed through an annular hardware 31 and then folded back toward the one end thereof before being coupled to a length adjustment buckle 32 for adjusting the length of the prevention device body 2, the length adjustment buckle 32 being provided between the one end and the other end of the prevention device body 2. Here, the prevention device body 2 can be freely attached to and removed from the annular hardware 31 through the locking tool 30.

As for the strap attachment part 5, while one end thereof is coupled to the annular hardware 31, the other end thereof includes: a biforked section 33 that is made of an elastic member such as a rubber cord or the like and is divided in a biforked manner; a first openable part 34 that is made of a band-shaped material and is connected to one end of the biforked section 33 divided; and a second openable part 35 that is made of a band-shaped material and is connected to the other end of the biforked section 33 divided. There are also provided a snap button(s) 36 as a third attachment/detachment section(s) for attaching or detaching the first openable part 34 to or from the second openable part 35.

The snap button(s) 36 include: a first concave portion 37 and a second concave portion 38 that are arranged in the longitudinal direction of the first openable part 34 and are provided away from each other at a predetermined interval; and a plurality of a first convex portion 39 and a second convex portion 40 that are arranged in the longitudinal direction of the second openable part 35 and are freely engageable with the first concave portion 37 and the second concave portion 38.

Here, as for the snap button(s) 36, once the first openable part 34 and the second openable part 35 have been coupled to each other by engaging the first concave portion 37 and the second concave portion 38 with the first convex portion 39 and the second convex portion 40, there shall be formed a closed annular portion 41 composed of the first openable part 34, the second openable part 35 and the biforked section 33.

Particularly, the length of the closed annular portion 41 can be freely adjusted by appropriately modifying a combination pattern with which the first concave portion 37 and the second concave portion 38 of the snap button(s) 36 are to be engaged with the first convex portion 39 and the second convex portion 40.

Described hereunder is a method for using the shoulder strap slippage prevention device 1 having the aforementioned structure. In the beginning, the slippage prevention device 1 is to be attached to the shoulder strap 4 of the shoulder bag 3 by passing this shoulder strap 4 through the closed annular portion 41.

Subsequently, with the slippage prevention device 1-attached shoulder strap 4 hanging on the shoulder 21 of the user, the prevention device body 2 is to be placed around the user's neck from his/her back side such that the other end of the prevention device body 2 having the balance weight part 6 may hang off the other shoulder 22, the balance weight part 6 containing coins (not shown) as weights.

As an effect of the aforementioned embodiment, if the biforked section 33 is elastic, the uncomfortable feeling of, for example, having the neck area pressed can be alleviated, and the ability to attach the slippage prevention device 1 to the shoulder strap 4 can be improved.

Third Embodiment

Figure 15:
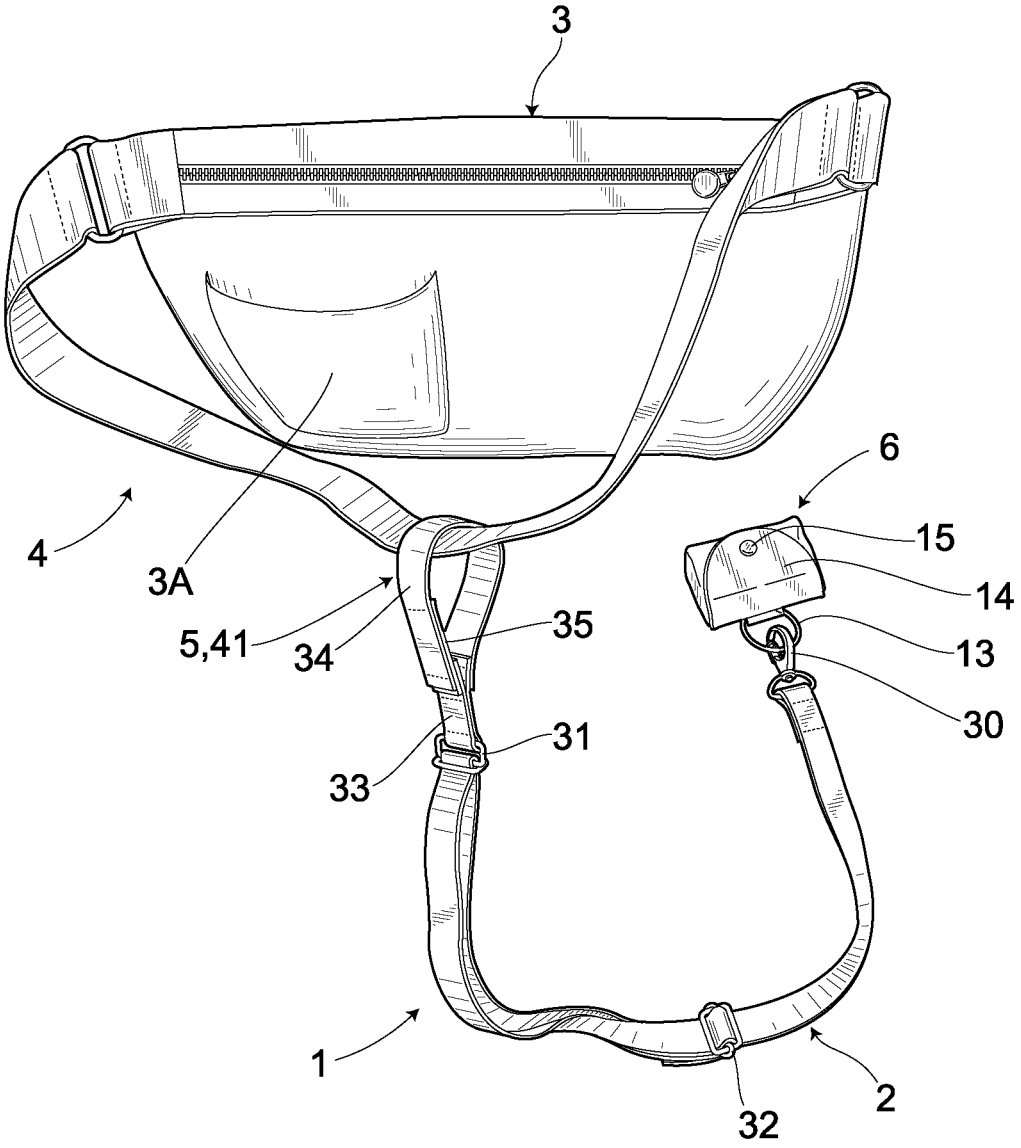
FIG. 15 is a plan view of a shoulder bag of a third embodiment of the present invention.
Figure 16:
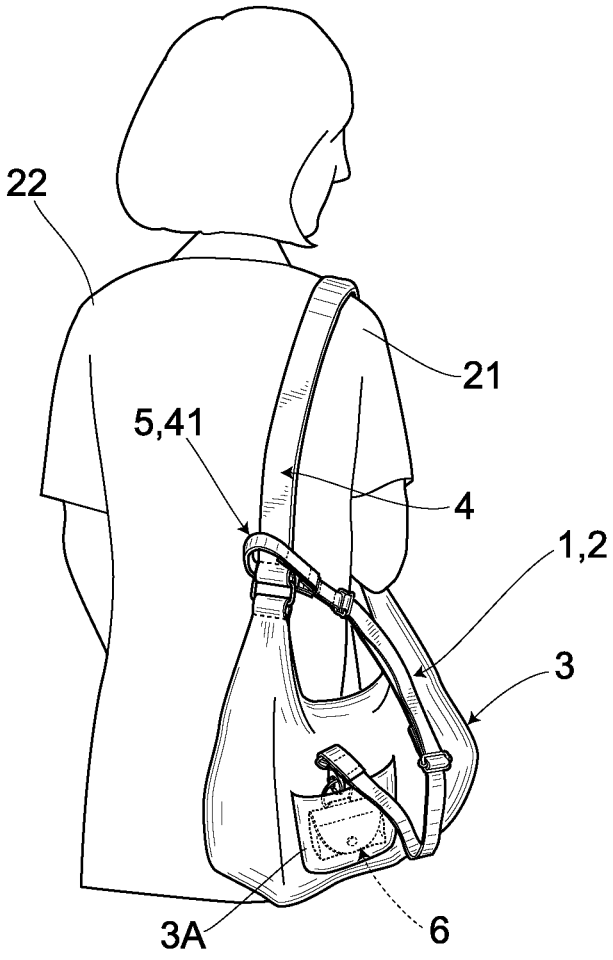
FIG. 16 is a rear view showing a state where a shoulder strap slippage prevention device is received in the shoulder bag of the third embodiment.

FIG. 15 and FIG. 16 show a third embodiment of the present invention. Here, elements identical to those of the first and second embodiments are given identical symbols, and the detailed descriptions thereof are thus omitted. As for the strap attachment part 5 in the third embodiment, the first openable part 34 and the second openable part 35 are sewn and integrally fixed to each other with the shoulder strap 4 being passed through the closed annular portion 41 in advance. That is, in the present embodiment, the slippage prevention device 1 is integrally attached to the shoulder strap 4 of the shoulder bag 3.

Described hereunder is a method for using the shoulder bag 3 having the aforementioned structure. When using the slippage prevention device 1, with the shoulder strap 4, having the slippage prevention device 1 attached thereto, being slung over the shoulder 21 of the user, the prevention device body 2 is to be placed around the user's neck from his/her back side such that the other end of the prevention device body 2 having the balance weight part 6, containing coins (not shown) as weights, may hang off the other shoulder 22.

Further, when not in use of the slippage prevention device 1, the shoulder bag 3 may simply be used as a normal shoulder bag with the balance weight part 6 being stowed inside the shoulder bag 3 or in a pocket 3A thereof.

Since the shoulder strap slippage prevention device 1 is attached to the shoulder strap 4 of the shoulder bag 3 in this manner, there can be provided the shoulder bag 3 capable of preventing the shoulder strap 4 from slipping off, the shoulder bag 3 not only having a degree of freedom of being wearable with simple actions, but also alleviating the uncomfortable feeling of having the user's body pressed.

The present invention is not limited to the aforementioned embodiments. In fact, various modified embodiments are possible within the scope of the present invention. For example, both the first and second attachment/detachment sections are not limited to surface fasteners. As a matter of fact, they may be appropriately modified to known attachment/detachment members such as snap buttons or the like. Further, the balance weight part 6 is not limited to a coin case. In fact, the balance weight part 6 may be a pouch capable of containing items other than coins but of a moderate weight (e.g. about 150 g). Particularly, the balance weight part 6 may also be a portable item that has a moderate weight and can hang off the folded-back portion 10, the annular hardware 13 and the locking tool 30, such portable item being, for example: a mobile terminal such as a cell phone or a smart phone; a camera; a flashlight; a portable radio/TV; music player; or a crime prevention buzzer. Moreover, the slippage prevention device 1 of the present invention is available not only for the shoulder strap 4 of the shoulder bag 3, but also for, for example: a general shoulder strap installed in a storage device that is carried by hanging the shoulder strap off one's shoulder, the storage device being a bag, a case, a pouch or the like; and a hanging string of an item slung over one's shoulder.

DESCRIPTION OF SYMBOLS

1 Slippage prevention device
2 Prevention device body
3 Shoulder bag
4 Shoulder strap
5 Strap attachment part
6 Balance weight part

The invention claimed is:

1. A storage device having a shoulder strap slippage prevention device comprising:
- a storage element with a shoulder strap;
- a band-shaped prevention device body;
- a strap attachment part allowing one end of said prevention device body to be attached to the shoulder strap of the storage element; and
- a balance weight part provided on an other end of said prevention device body,
- wherein said prevention device body comprises:
- an annular hardware that said balance weight part is coupled to;
- a first attachment/detachment section openably closing one end of said prevention device body;
- a second attachment/detachment section openably closing the other end of said prevention device body;
- a length adjustment buckle adjusting a length of said prevention device body; and
- a fixation buckle fixing a position of said annular hardware,
- wherein said strap attachment part is attached to the shoulder strap slung over one shoulder of a user, said prevention device body is then placed around the user's neck such that said balance weight part can hang off an other shoulder of the user, thereby allowing a weight of said balance weight part to develop a tensile force to be applied to said prevention device body in a range from said one shoulder to said other shoulder.

2. The storage device having a shoulder strap slippage prevention device according to claim 1, wherein said balance weight part is configured as a coin case, having said annular hardware coupled to a central part on a top surface of said balance weight part.

3. The storage device having a shoulder strap slippage prevention device according to claim 2, wherein said first attachment/detachment section and said second attachment/detachment section are surface fasteners.

4. The storage device having a shoulder strap slippage prevention device according to claim 1, wherein said first attachment/detachment section and said second attachment/detachment section are surface fasteners.

5. A storage device having a shoulder strap slippage prevention device comprising:
- a storage element with a shoulder strap;
- a band-shaped prevention device body;
- a strap attachment part allowing one end of said prevention device body to be attached to the shoulder strap of the storage element; and
- a balance weight part provided on an other end of said prevention device body, wherein said prevention device body comprises:
- an annular hardware that said balance weight part is coupled to; and
- a length adjustment buckle adjusting a length of said prevention device body, wherein one end of said strap attachment part is coupled to said annular hardware, while the other end thereof is divided in a biforked manner, said strap attachment part including a third attachment/detachment section, and wherein said strap attachment part is attached to the shoulder strap slung over one shoulder of a user, and said prevention device body is then placed around the user's neck such that said balance weight part can hang off an other shoulder of the user, thereby allowing a weight of said balance weight part to develop a tensile force to be applied to said prevention device body in a range from said one shoulder to said other shoulder.

6. The storage device having a shoulder strap slippage prevention device according to claim 5, wherein said balance weight part is configured as a coin case, having said annular hardware coupled to a central part on a top surface of said balance weight part.

7. The storage device having a shoulder strap slippage prevention device according to claim 6, wherein said third attachment/detachment section is a snap button(s).

8. The storage device having a shoulder strap slippage prevention device according to claim 6, wherein said third attachment/detachment section is a snap button(s).

* * * * *